United States Patent [19]

Benning et al.

[11] 4,335,814

[45] Jun. 22, 1982

[54] BOTTLE CARTON WITH INTEGRAL OPENER

[76] Inventors: Leroy J. Benning, 5012 Turner Rd., Sebastopol, Calif. 95472; Charles A. Thorman, 1497 McGregor, Petaluma, Calif. 94952

[21] Appl. No.: 937,026

[22] Filed: Aug. 25, 1978

[51] Int. Cl.[3] ..... B65D 75/00; B67B 7/16

[52] U.S. Cl. ..... 206/198; 81/3.3 A; 229/52 B

[58] Field of Search ..... 206/198; 81/3.3 A; 229/28 BC, 52 B

[56] References Cited

U.S. PATENT DOCUMENTS

| | | | |
|---|---|---|---|
| 2,665,838 | 1/1954 | Forrer | 229/28 BC |
| 2,806,393 | 9/1957 | Vickers | 81/3.3 A |
| 2,990,972 | 7/1961 | Benedetti | 206/198 |
| 3,055,541 | 9/1962 | Bonkowski | 206/198 |

*Primary Examiner*—George E. Lowrance
*Attorney, Agent, or Firm*—Townsend and Townsend

[57] ABSTRACT

In a bottle carrying carton of the type having a doubled over medial, multilaminous cardboard handle, a bottle opener is placed. The opener includes an elongate flat shank captured between the laminations of the handle, and an overhanging opposed hook mounted at one end of the shank. A portion of the shank proximate the hook protrudes beyond the handle and defines a bearing surface. The overhanging hook is preferably broadened to capture at least two serrations of a bottle cap. A capped bottle is placed so that the protruding edge of a serrated cap catches the hook, while the broad surface or top of the cap bears against the bearing surface. Both the hook and the bearing surface are angulated, so that the bottle is in a downwardly angled position immediately before being opened. Opening of the bottle occurs by further downward rotation while the carton is grasped typically at the handle.

5 Claims, 4 Drawing Figures

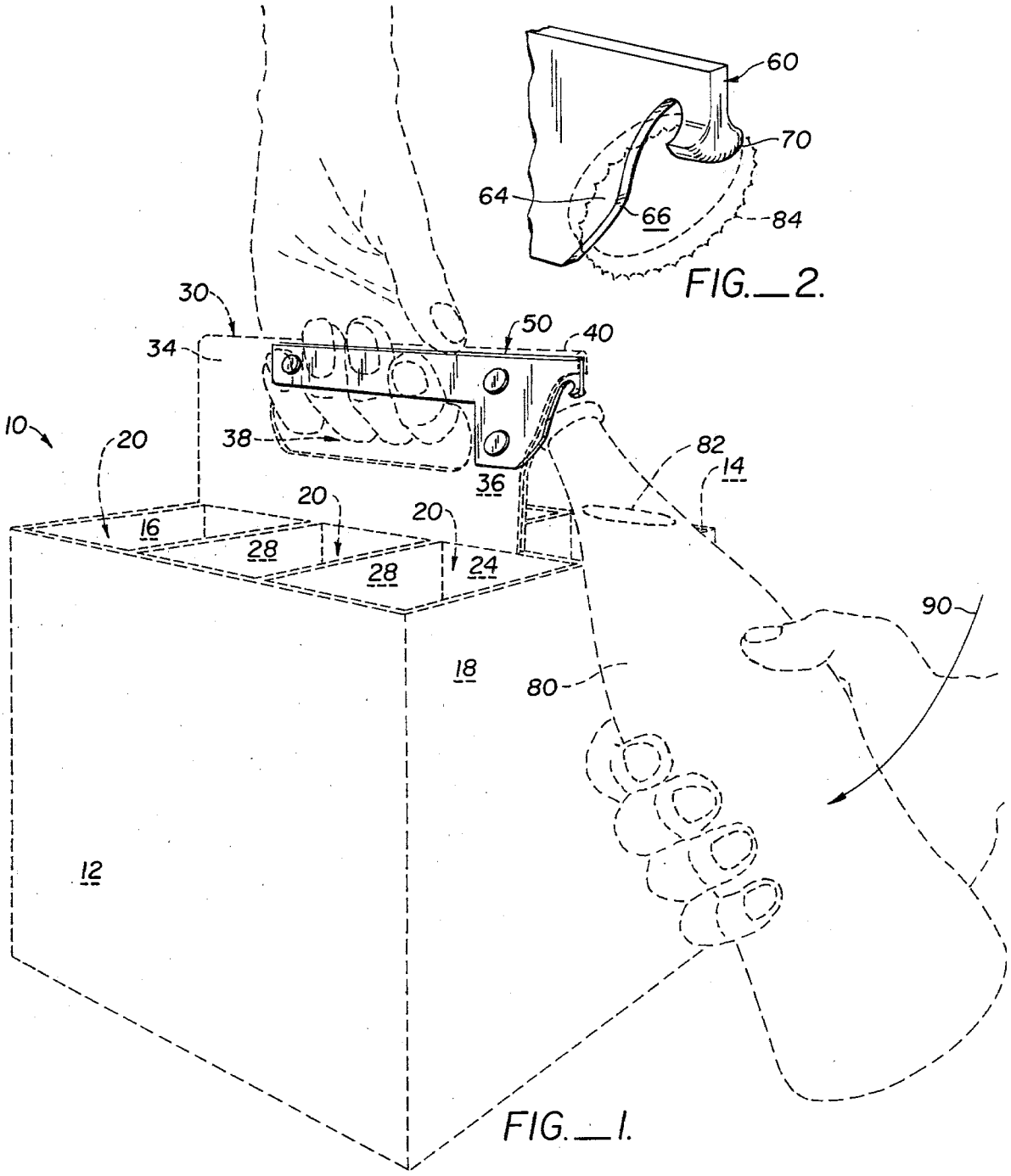
FIG. 2.
FIG. 1.
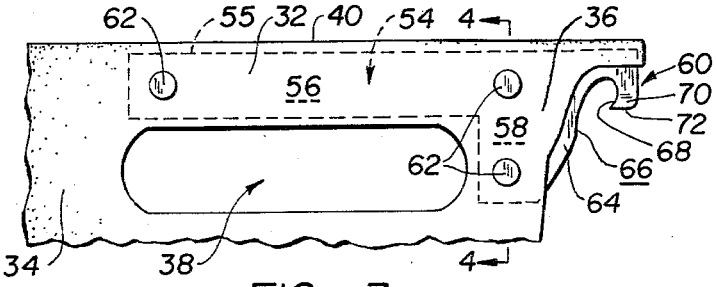
FIG. 3.
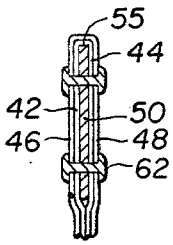
FIG. 4.

BOTTLE CARTON WITH INTEGRAL OPENER

This invention relates to an opener integrally formed to the multilaminous handle of a folding cardboard carton for transporting bottles.

SUMMARY OF THE PRIOR ART

Folding cardboard cartons for the transport of bottles are known. These cartons typically include six side by side compartments supported from a central multilaminous handle which is typically slotted to allow it to be gripped by the fingers. Designs of handles used with such bottle carrying cartons are shown in U.S. Pat. Nos. 3,062,404; 3,236,414; 3,128,906; 3,349,957; 3,190,487 and 3,443,723.

It is known in the prior art to affix openers to the cardboard handles of such cartons. See for example U.S. Pat. Nos. 2,806,393 and 2,990,972. However, such bottle openers placed in carton handles have only operated upon upward movement of the bottle about the opener. This leads to one of two situations, either of which is undesirable.

First, if the carton is maintained level, the contents of the bottle are disposed against the cap at the time it is opened. As most bottled soft drinks are carbonated, the contents of the bottle leak outwardly under pressure at the time the cap is removed. The bottle contents thus wet the carton, possibly weakening it or rendering it messy and unsanitary.

Alternately, if the bottle is held relatively upright, opening can only occur by manipulation of the entire carton. Since one or more of the carton pockets are typically filled with bottles, this can be unwieldy.

For the foregoing reasons, any possible benefits of such integral openers have generally been outweighed by the disadvantages, and cartons having integral openers have not found their way into common use.

SUMMARY OF THE INVENTION

The invention provides a bottle opener mounted within the medial, multilaminous cardboard handle of a bottle carrying carton. Opening of a bottle occurs without leakage or spillage, and without requiring unwieldy manipulation of the carton.

The opener includes an elongate and flat shank disposed between the laminations of the handle and contronted at its upper edge to an upper fold of the handle. The shank is typically glued in position, and may be further held by rivets. The shank preferably extends at least partially along the gripped portion of the handle. A portion of the shank protrudes beyond an end of the handle, thereby defining a bearing surface, and has mounted thereto an opposed overhanging hook. A capped bottle is placed so that the protruding edge of a serrated cap catches the hook, while the top of the cap bears against the portion of the shank immediately below the hook that defines the bearing surface. The overhanging hook is preferably broadened to capture at least two serrations of the cap. Both the hook and the bearing surface are angulated, so that the bottle is in a downwardly angled position immediately before being opened. Opening of the bottle occurs by further downward rotation while the carton is grasped, typically at the handle.

OTHER OBJECTS AND ADVANTAGES OF THE INVENTION

An object of this invention is to disclose an opener which can be used in conjunction with a bottle holding carton. In accordance with this aspect of the invention, the carton is provided with an outwardly extending hook for catching the serrations of a bottle cap. The hook is aligned in cooperation with a bearing surface, so that the bottle angulates downwardly from its top when the cap is placed in the opener. By downward rotation of the bottle, the hook on the carton effects removal of the serrated cap.

An advantage of this general aspect of this invention is that it provides to bottle carrying cartons a self-opening feature. This enhances the convenience of recyclable glass bottles having biodegradable steel caps (as distinguished from non-biodegradable aluminum cans), and therefore encourages their use.

An advantage of the opener configuration of the invention is that no spillage of the bottle contents into the carton results during opening. Weakening of the cardboard of the container or soiling of the container to an unsanitary state is avoided.

A further object of this invention is to disclose a bottle opener attached to a shank, which shank is embedded between the laminations and against the folded border of a multilaminous handle on a carton.

An advantage of this aspect of the invention is that the folded border of the handle rigidly clasps the opener therebetween. As the shank of the opener tends to pivot upwardly during opener use, the folded border of the multilaminous handle intimately resists such movement. An opener rigidly fastened to the container handle results.

A further advantage of this aspect of the invention is that the carton can be gripped at the handle during opening movement of a bottle. Since the shank of the opener of this invention preferably extends through the gripped portion of the handle, all movement of the opener and carton is resisted.

Yet another advantage of this aspect of the invention is that the handle of the container is serendipitously reinforced by the opener. A container having increased overall strength results.

Yet a further advantage of this aspect of the invention is that it can be naturally placed during the manufacture of a carton. By the expedient of placing the opener edge along a line that subsequently is formed into the folded upper border handle of the carton, the opener of this invention conforms to the manufacturing process.

Other objects, features and advantages of this invention will become more apparent after referring to the following specification and attached drawings in which:

BRIEF DESCRIPTION OF THE DRAWINGS

FIG. 1 is a perspective view showing the disposition of the bottle opener of this invention within the handle of a bottle carrying carton;

FIG. 2 is a fragmentary perspective view illustrating in greater detail the construction of the hook portion and bearing surface of the bottle opener;

FIG. 3 is a side elevational view of the carton handle and bottle opener; and FIG. 4 is a sectional view taken along line 4—4 of FIG. 3.

DESCRIPTION OF THE PREFERRED EMBODIMENT

FIG. 1 illustrates the disposition of the bottle opener of the present invention within the handle of a bottle carrying carton, the carton being shown in phantom, and further shows the overall carton construction. Broadly, a carton 10 comprises vertical opposed side walls 12 and 14, and vertical end walls 16 and 18, end walls 16 and 18 being substantially perpendicular to side walls 12 and 14. The interior volume of carton 10 is divided into a plurality of bottle receiving chambers 20, by medially extending wall 24 parallel to side walls 12 and 14, and partition walls 28, extending between medial wall 24 and side wall 12. Additional partition walls extending between medial wall 24 and side wall 14 are not shown. It should be understood that the above description of the orientation of the walls is with reference to the carton in an opened upright position. In the preferred embodiment, carton 10 is constructed so that in the absence of bottles, it may be folded into a substantially flat configuration with all the walls lying generally in a plurality of closely spaced planes. When the carton is folded, each of end walls 16 and 18 folds into two halves, with the halves of wall 16 confronting medial wall 24 on opposite surfaces thereof, and the halves of wall 18 confronting each other. Thus handle 30 is offset from side walls 12 and 14.

The general construction of bottle carrying carton 10 is known in the art, various aspects being described in U.S. Pat. Nos. 3,062,404 to Arneson; 3,128,906 to Forrer; 3,190,487 to Wood; 3,236,414 to Slevin, Jr.; 3,349,957 to Wood; and 3,443,723 to Arneson.

Medial wall 24 extends upwardly beyond top edges of walls 12, 14, 16 and 18 to define a medially extending handle 30. FIGS. 3 and 4 show additional details of typical handle construction. A hand confronting portion 32 and spaced apart supporting members 34 and 36 surround a central hand receiving slot 38, slot 38 allowing a user to carry or otherwise support carton 10 by placing a hand, shown in phantom, through slot 38 and curling the fingers about hand confronting member 32. Handle 30 is of multilaminous construction, the laminations being folded to define an upper edge 40 of handle 30. As best seen in FIG. 4, handle 30 includes inner laminations 42 and 44 and typically includes outer laminations 46 and 48.

FIGS. 1, 2, and 3 illustrate the preferred construction of a bottle opener 50 of the present invention. Opener 50 generally comprises an elongate flat shank 54 having an upper edge 55 and including a narrow shank portion 56 and a broadened shank portion 58, and an overhanging hook 60 mounted to broadened shank portion 58. Opener 50 is preferably constructed of metal, aluminum being a suitable material.

Referring to FIGS. 1 and 3, the relationship of shank portions 56 and 58 to the various portions of handle 30 can be seen. Preferably, upper edge 55 of opener 50 is captured in the fold defined by handle laminations 42 and 44, and extends in the medial plane. Broadened shank portion 58 is preferably disposed between those portions of laminations 42 and 44 defining supporting member 36 while narrow shank portion 56 is between those portions of laminations 42 and 44 that define at least a part of hand confronting portion 32. Opener 50 is preferably glued between the laminations of handle 30, but may also be fastened thereto by rivets 62 which pass through shank 54 and laminations 42, 44, 46, and 48.

A portion 64 of broadened shank portion 58 extends beyond the cardboard laminations forming handle 30. An edge 66 of protruding shank portion 64 defines a bearing surface angled downwardly away from hook 60 toward handle 30. Bearing surface 66 is opposed by a facing portion 68 of hook 60. The position of opener 50 within handle 30 is preferably such that hook 60 does not extend beyond the general confines of carton 10. Thus no parts of the opener extend beyond a vertical projection of end wall 18. The configuration of hook 60 may be further understood with reference to FIG. 2. In particular, hook 60 has a lower portion 70 which is broadened relative to shank 54. Lower hook portion 70 has a lower surface 72 which is curved in a convex manner.

Placement of opener 50 within handle 30 is preferably carried out during manufacture of carton 10. Carton 10 is typically made by a process where a sheet of cardboard is die cut, creased, glued, and folded. In such a process, the opener is preferably placed with upper edge 55 along the crease that ultimately defines upper edge 40 of handle 30, prior to folding. When folded carton is configured as described above, the offset of walls 12 and 14 relative to handle 30 ensures that opener 50 is well removed from the outermost confines of the folded carton.

The operation of the present invention is best seen with reference to FIGS. 1 and 2. A bottle 80, being in general partially filled with liquid to define a liquid air interface 82, and having a cap 84 to be removed, is placed with the serrated portion of cap 84 confronting inner surface 68 of hook 60 while the top of cap 84 confronts and bears against bearing surface 66. The angulation of bearing surface 66 and opposed hook surface 68 ensures that bottle 80 is angled generally downward so that the liquid does not confront cap 84 during this operation. The downard slope of bearing surface 66 extends to the lower margin of broadened shank portion 58 so that no portion of the shank extends into the region directly underneath hook 60. The broadening of lower portion 70 of hook 60 provides that surface 68 of hook 60 confronts at least two serrations of cap 84. Additionally, the broadening and curvature of lower portion 70 of hook 60 reduces the danger of damage caused by the hook, as the hook presents an expanded and rounded surface that is no more dangerous than the curved surface presented by the bottle caps themselves. The likelihood of damage is also reduced due to the positioning of hook 60 inside the confines of carton 10.

In order to effect opening of the bottle, the user grasps hand confronting portion 32 of handle 30, thereby also in effect grasping narrow shank portion 54, with one hand, and with the other hand causes bottle 80 to rotate in a generally downward direction indicated by arrow 90, the rotation being about the region where the top of cap 84 contacts bearing surface 66. At no time during this opening procedure are the liquid contents of bottle 80 in contact with the inside of cap 84. Thus, spillage which could weaken the cardboard carton and cause an unsanitary condition is eliminated.

During opening, any tendency of shank 54 to move upward is resisted by the fold between laminations 42 and 44 that captures top edge 55 of shank 54. Since narrow shank portion 56 extends at least part of the way along gripped portion 32 of handle 30, the opener reinforces the handle. This reinforcement is important during the opening of the bottle since forces on the opener could otherwise distort and weaken the handle. Moreover, the reinforcement provides a stronger handle for carrying, reducing the possibility of handle failure.

We claim:

1. In a bottle carrying carton having a folded medial multilaminous cardboard handle lying in a normally vertical plane to define an upper folded border, the handle having a hand confronting portion, an improved bottle opener comprising:

an elongate flat shank lying substantially in the plane of the handle, the flat shank being disposed between first and second laminations of the handle, and having an upper edge captured in the fold defined by the upper folded border of the handle and abutting the fold;

the flat shank having a narrow portion extending along at least part of the length of the hand confronting portion of the handle, and a broadened shank portion protruding beyond the handle;

an overhanging hook mounted to the shank proximate the protruding portion;

the protruding portion of the shank opposing the hook to define a bearing surface;

the overhanging hook being angulated toward the handle, and the bearing surface sloping downwardly away from the hook towards the handle, wherein the axis of a bottle having a cap to be removed is downwardly angled away from the opener and the carton when a serration of the cap engages the hook and the top of the cap engages the bearing surface, cap removal being effected by rotating the bottle further downward about the region of contact between the cap and the bearing surface wherein the protruding portion of the shank is devoid of material in the region under the hook so that the bottle may be opened without interference from the shank; and means preventing movement of the shank relative to the handle so that the carton provides a firm support for the opener during opening with the narrow portion of the shank reinforcing the handle against distortion.

2. The invention of claim 1 wherein the narrow portion of the shank extends along the entire length of the hand confronting portion of the handle.

3. The invention of claim 1 wherein the hook has a lower portion that is broadened relative to the shank in a direction perpendicular to the plane of the shank, and is rounded.

4. In a bottle carrying carton having a medial handle lying in a normally vertical plane, the handle having a hand confronting portion, an improved bottle opener comprising:

an elongate flat shank lying substantially in the plane of the handle and embedded therein, the flat shank having a narrow portion extending along at least part of the length of the hand confronting portion of the handle and a broadened shank portion protruding beyond the handle;

an overhanging hook mounted to the shank proximate the protruding portion;

the protruding portion of the shank being angled downward and away from the hook to define a bearing surface, the downward angulation away from the hook extending to a lower margin of the shank so that the region under the hook is devoid of material, the overhanging hook being angulated toward the handle and the bearing surface sloping downwardly away from the hook towards the handle wherein the axis of a bottle having a cap to be removed is downwardly angled away from the opener and carton when a serration of a cap engages the hook and the top of the cap engages the bearing surface, cap removal being effected by rotating the bottle further downward about the region of contact between the cap and the bearing surface, rotation occurring without interference from portions of the shank; and means preventing movement of the shank relative to the handle so that the carton provides a firm support for the opener during opening with the narrow portion of the shank reinforcing the handle against distortion.

5. The invention of claim 4 wherein the hook has a lower portion that is broadened relative to the shank in a direction perpendicular to the plane of the shank.

* * * * *